US009163873B2

(12) United States Patent
Jakobsen et al.

(10) Patent No.: US 9,163,873 B2
(45) Date of Patent: Oct. 20, 2015

(54) METHOD AND SYSTEM FOR OPTIMIZED LNG PRODUCTION

(75) Inventors: Arne Jakobsen, Asker (NO); Carl J. Rummelhoff, Moss (NO); Bjorn H. Haukedal, Bekkestua (NO)

(73) Assignee: Wärtsilä Oil & Gas Systems AS, Asker (NO)

( * ) Notice: Subject to any disclaimer, the term of this patent is extended or adjusted under 35 U.S.C. 154(b) by 207 days.

(21) Appl. No.: 13/061,382

(22) PCT Filed: Aug. 27, 2009

(86) PCT No.: PCT/NO2009/000302

§ 371 (c)(1),
(2), (4) Date: Apr. 15, 2011

(87) PCT Pub. No.: WO2010/024691

PCT Pub. Date: Mar. 4, 2010

(65) Prior Publication Data

US 2011/0203312 A1 Aug. 25, 2011

(30) Foreign Application Priority Data

Aug. 29, 2008 (NO) ..... 20083740

(51) Int. Cl.
*F25J 1/00* (2006.01)
*F25J 1/02* (2006.01)

(52) U.S. Cl.
CPC ..... *F25J 1/0022* (2013.01); *F25J 1/005* (2013.01); *F25J 1/0025* (2013.01); *F25J 1/0072* (2013.01);

(Continued)

(58) Field of Classification Search
CPC ..... F25J 1/0022; F25J 1/005; F25J 1/0072; F25J 1/0204; F25J 1/0205; F25J 1/0249; F25J 1/0207; F25J 2270/16; F25J 1/0057; F25J 1/0203; F25J 1/0025
USPC ..... 62/606, 607, 608, 611, 614, 623
See application file for complete search history.

(56) References Cited

U.S. PATENT DOCUMENTS 3,724,226 A 4/1973 Pachaly
3,894,856 A * 7/1975 Lofredo et al. ..... 95/115

(Continued)

FOREIGN PATENT DOCUMENTS

CN 101223410 7/2008
DE 10 2006 039 889 2/2008

(Continued)

OTHER PUBLICATIONS

OTC 19339: Trends and Technologies in LNG Carrier and Offshore LNG Facilities (May 2008).*

(Continued)

*Primary Examiner* — Frantz Jules
*Assistant Examiner* — Keith Raymond
(74) *Attorney, Agent, or Firm* — Morrison & Foerster LLP

(57) ABSTRACT

A method and system for producing liquefied and sub-cooled natural gas by means of a refrigeration assembly using a single phase gaseous refrigerant comprising: at least two expanders (1-3); a compressor assembly (5-7); a heat exchanger assembly (8) for heat absorption from natural gas; and a heat rejection assembly (10-12). The novel features according to the present invention are arranging the expanders (1-3) in expander loops; using only one and the same refrigerant in all loops; passing an expanded refrigerant flow from the respective expander into the heat exchanger assembly (8), each being at a mass flow and temperature level adapted to de-superheating, condensation or cooling of dense phase and/or sub-cooling of natural gas; and serving the refrigerant to the respective expander in a compressed flow by means of the compressor assembly having compressors or compressor stages enabling adapted inlet and outlet pressures for the respective expander.

14 Claims, 8 Drawing Sheets

(52) U.S. Cl.
CPC ..... *F25J 1/0204* (2013.01); *F25J 1/0205* (2013.01); *F25J 1/0207* (2013.01); *F25J 1/0249* (2013.01); *F25J 1/0279* (2013.01); *F25J 1/0288* (2013.01); *F25J 1/0298* (2013.01); *F25J 2270/16* (2013.01); *F25J 2270/60* (2013.01); *F25J 2270/902* (2013.01)

(56) References Cited

U.S. PATENT DOCUMENTS

| | | | | |
|---|---|---|---|---|
| 4,455,614 | A | 6/1984 | Martz et al. | |
| 4,608,067 | A * | 8/1986 | Marshall | 62/613 |
| 5,768,912 | A * | 6/1998 | Dubar | 62/613 |
| 5,791,160 | A * | 8/1998 | Mandler et al. | 62/611 |
| 5,916,260 | A | 6/1999 | Dubar | |
| 6,412,302 | B1 * | 7/2002 | Foglietta | 62/611 |
| 6,640,586 | B1 | 11/2003 | Baudat et al. | |
| 6,691,531 | B1 | 2/2004 | Martinez et al. | |
| 7,225,636 | B2 | 6/2007 | Baudat | |
| 2003/0089125 | A1 * | 5/2003 | Fredheim et al. | 62/612 |
| 2003/0226373 | A1 | 12/2003 | Prible et al. | |
| 2009/0217701 | A1 | 9/2009 | Minta et al. | |
| 2010/0175423 | A1 | 7/2010 | Walther | |
| 2010/0175424 | A1 | 7/2010 | Walther | |
| 2010/0175425 | A1 | 7/2010 | Walther | |
| 2010/0175862 | A1 | 7/2010 | Franklin et al. | |
| 2012/0324861 | A1 | 12/2012 | Koelscheid et al. | |

FOREIGN PATENT DOCUMENTS

| | | | |
|---|---|---|---|
| EP | 1 455 152 | | 9/2004 |
| EP | 1 903 189 | | 3/2008 |
| EP | 1 939 564 | | 7/2008 |
| EP | 1959217 | A2 * | 8/2008 |
| KR | 100747372 | B1 * | 8/2007 |
| NO | 323496 | | 5/2007 |
| NO | 20083740 | | 3/2010 |
| WO | WO-02/48509 | | 6/2002 |
| WO | WO 2005047761 | A1 * | 5/2005 |
| WO | WO 2006098630 | A1 * | 9/2006 |
| WO | WO-2007/021351 | | 2/2007 |
| WO | WO-2008/081018 | | 7/2008 |
| WO | WO-2010/024691 | | 3/2010 |
| WO | WO-2010/104498 | | 9/2010 |

OTHER PUBLICATIONS

Cryostar Magazine Special Report on Reliquefaction System EcoRel (Autumn 2007).*
Liquefaction Solutions for Challenge of New Offshore FPSO Developments (Feb. 2008).*
The Latest in Floating LNG Technologies (Mar. 2008).*
A New Multistage Gas Phase Auto-Refrigeration Process for LNG (Nov. 2006).*
Breaking the offshore LNG stalemate (Apr. 2007).*
New FPSO design produces LNG from offshore sources—Oil & Gas Journal (2002).*
Evaluation of Natural Gas Liquefaction Processes for Floating Applications Offshore (2010).*
Norwegian Search Report dated Feb. 17, 2010, directed to Norwegian Application No. 20083740; 2 pages.
Foglietta, J. et al. (Sep. 1, 2002). "New Process Technologies for LNG and NGL Production," GPA Annual Conference, pp. 1-40.
Horlyk et al., U.S. Office Action mailed Mar. 29, 2013, directed to U.S. Appl. No. 13/127,704; 8 pages.
International Search Report and Written Opinion mailed Jan. 19, 2012, directed to International Application No. PCT/NO2009/000362; 11 pages.
First Office Action mailed Dec. 12, 2012, directed to CN Application No. 200980143991.6; 9 pages.
Patent Examination Report No. 1 dated Aug. 4, 2012, directed to AU Application No. 2009311781; 3 pages.
Foglietta, J. H. (1999). "New LNG Process Scheme," presented at the 78th Annual GPA Convention; pp. 1-5.
Patent Examination Report No. 1 dated Jun. 16, 2012, directed to AU Application No. 2009286189; 3 pages.

* cited by examiner

METHOD AND SYSTEM FOR OPTIMIZED LNG PRODUCTION

BACKGROUND OF THE INVENTION

The energy demand in the world is increasing, and the forecast is a continued growth. Gas as an energy carrier has received increased attention recent years, and it is predicted that gas will become even more important. In order to transport gas over longer distances, liquefied natural gas, LNG, is often regarded as the best option, especially overseas.

Stranded gas or associated gas are gas sources which are "waste products" from oil production. These gas sources are today seldom utilized. They are commonly flared. With the increasing gas prices and more focus on the environment, it has become more economically viable and more politically important to utilize these sources. Many of these sources are offshore, and liquefaction on a floating production storage and offloading, FPSO, unit is in many cases the best option. FPSO's offer flexibility since they can be moved relatively easy to other sources. A challenge on the FPSO's is the space available. Furthermore, the weight of the equipment should be minimized, and the refrigerant should preferably be non-combustible.

An important issue for LNG production is the energy demand. High energy demand per kg produced LNG, i.e. specific energy consumption, makes it less profitable and less environmental friendly. The number of economically viable gas sources will be narrowed. Besides reducing operating cost, lower specific energy demand will also save investment cost, since the equipment will be smaller.

LNG production onshore does not have the same limitations with regard to weight and space but energy efficient LNG production is just as important. As the capacities of the plants gets larger, energy efficiency becomes more important.

Technology involving multi component refrigerant, MCR, often in cascades arrangements, is regarded as the most efficient technology for LNG production. It is commonly used in larger plants, base load plants, and to some extent in medium scale plants. Due to its complexity, MCR-technology is costly and control is slow. In addition, a gas make-up assembly is needed to ensure the correct composition of the MCR refrigerant. Another disadvantage is that the refrigerant is combustible which may be a problem, especially in offshore installations.

If a single component refrigeration technology using an inert gas, such as nitrogen, can be comparably energy efficient, it will represent a major improvement in terms of cost, compactness, weight, robustness, control, and safety. This technology can then be interesting to implement also in large scale plants.

U.S. Pat. Nos. 5,768,912 and 5,916,260 propose processes for LNG production based on nitrogen single refrigerant technology. The refrigerant is divided into at least two separate flows which are cooled and expanded in at least two separate expanders. Each of the flows are expanded down to the suction pressure of the compressor train, which is the lowest refrigerant pressure in the arrangement, thus using more energy than necessary.

U.S. Pat. No. 6,412,302 describes a LNG liquefaction assembly using two independent expander refrigeration cycles, one with methane or a mixture of hydrocarbons, and the other with nitrogen. Each cycle has one expander operating at different temperature levels. Each of the cycles can be controlled separately. Using two separate refrigerants will require two refrigerant buffer systems. Also using a flammable refrigerant implies restrictions or extra equipment.

Several patents are granted for MCR processes and apparatus using process gas as refrigerant, e.g. U.S. Pat. No. 7,225,636 and EP patent 1455152. Common for these are that heat absorption includes phase change of refrigerant, which inherently gives a more complex system. More equipment is needed and the control becomes complicated and sensitive.

There is a need for efficient processes based on an inert single component refrigerant. The present invention describes an energy efficient and compact LNG production assembly with a flexible control using an inert gas as refrigerant.

SUMMARY OF THE INVENTION

The current invention relates to a method and apparatus for optimized production of LNG. In order to minimize the specific energy consumption, the heat exchanger losses have to be minimized. This is achieved by arranging at least two expanders in single component and single phase refrigeration cycle(s) so that the mass flows, temperatures and pressure levels into the expanders can be controlled separately. By this arrangement, the refrigeration process can be adapted to varying gas compositions at different pressures and temperatures, and at the same time optimize efficiency. The control is inherently robust and flexible. A LNG production plant according to the present invention can be adapted to different gas sources and at the same time maintain the low specific energy consumption.

In one aspect the present invention relates to a method for producing liquefied and sub-cooled natural gas by means of a refrigeration assembly using a single phase gaseous refrigerant comprising: at least two expanders; a compressor assembly; a heat exchanger assembly for heat absorption from natural gas; and a heat rejection assembly, and further comprising: arranging the expanders in expander loops; using only one and the same refrigerant in all loops; passing an expanded refrigerant flow from the respective expander into the heat exchanger assembly, each being at a mass flow and temperature level adapted to de-superheating, condensation or cooling of dense phase and/or sub-cooling of natural gas; and serving the refrigerant to the respective expander in a compressed flow by means of the compressor assembly having compressors or compressor stages enabling adapted inlet and outlet pressures for the respective expander.

In another aspect the present invention relates to a system for producing liquefied and sub-cooled natural gas by means of a refrigeration assembly using a single phase gaseous refrigerant comprising: at least two expanders; a compressor assembly; a heat exchanger assembly for heat absorption from natural gas; and a heat rejection assembly, wherein the expanders are arranged in expander loops; only one and the same refrigerant is used in all loops; an expanded refrigerant flow from the respective expander is passed into the heat exchanger assembly, each being at a mass flow and temperature level adapted to de-superheating, condensation or cooling of dense phase and/or sub-cooling of natural gas; and the refrigerant to the respective expander is served in a compressed flow by means of the compressor assembly having compressors or compressor stages enabling adapted inlet and outlet pressures for the respective expander.

Favourable embodiments are specified by the dependent claims.

Outlet pressures of the expanders are controlled to be as high as possible but at the same time feeding the heat exchanger arrangement for sub-cooled LNG production with required refrigerant temperatures. Suction pressures for each of the compressor stages are then kept as high as possible.

This is unlike prior art, see e.g. U.S. Pat. No. 5,916,260, wherein all streams are expanded down to the lowest refrigerant pressure. A major improvement with the present invention is that specific work and suction volumes of the compressors are minimized, thus improving the overall system efficiency. Pipeline dimensions are reduced with smaller valves and actuators as a consequence. All these factors contribute to a significant cost and space need reduction. Installation work will also become less complicated and hence more efficient.

Reducing heat exchanger losses is of vital importance in low temperature processes. An important embodiment of the present invention is that it reduces the temperature differences to a minimum by adapting the refrigeration process to the principally three different stages of LNG production: de-superheating, condensation (cooling of dense phase at super-critical pressures) and sub-cooling. This is unlike prior art technology, e.g. U.S. Pat. No. 6,412,302, not having separate adaptation for de-superheating and condensation/cooling of dense phase.

The present invention will operate with single refrigerant in the gas phase. Nitrogen is an obvious alternative. The non-flammability is regarded as an advantage in for instance offshore installations. Using only one single component refrigerant also reduces complexibility.

BRIEF DESCRIPTION OF THE DRAWINGS

The accompanying drawings illustrate preferred embodiments of the present invention.

DETAILED DESCRIPTION OF THE INVENTION

Figure 1:
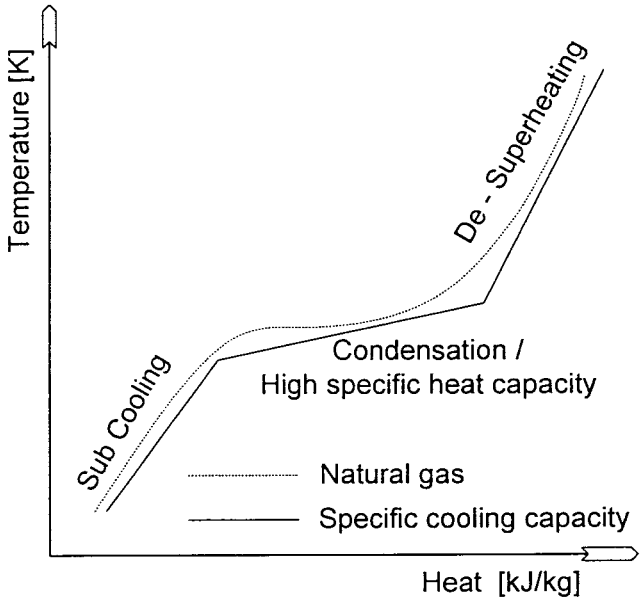
FIG. 1 shows the principle stages of liquefied natural gas production with corresponding cooling capacity needs represented by the straight lines.
Figure 2:
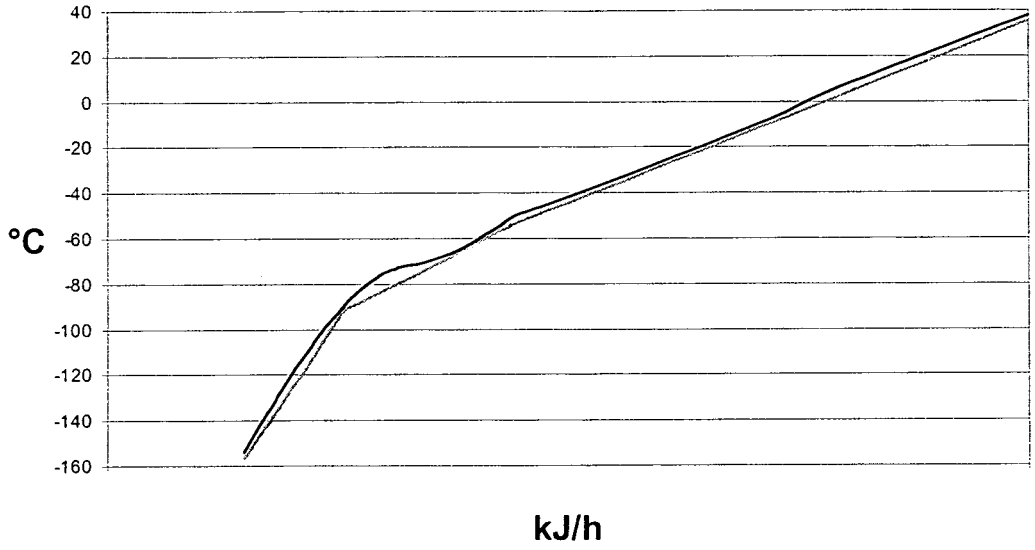
FIG. 2. illustrates an example of the warm and cold composite curves of the present invention.

The present invention relates to production of liquefied natural gas, LNG. Dependent on the gas source, the composition will vary. For instance, a gas composition can include 88% methane, 9% heavier hydrocarbons, 2% carbon dioxide, and 1% water, nitrogen and other trace gases. Before liquefaction, the concentration of carbon dioxide, water (which will freeze) and harmful trace gases such as $H_2S$ needs to be reduced to acceptable levels or eliminated from the gas stream. The well gas will undergo a pre-treatment step before entering the liquefaction step. In FIGS. 3 to 6, this pre-treated natural gas stream is indicated with reference numeral 9.

The process of LNG production can principally be divided into three different stages. A) De-Superheating, B) Condensation and C) Sub-cooling, see the schematically sketch in FIG. 1. The critical pressure of methane is around 46 bar. Dependent on the natural gas source composition, the critical pressure will vary from 46 bar and upwards. Above critical pressure for a natural gas composition, condensation is not possible. However, instead of condensation, the gas will pass a stage with increased specific heat capacity.

Each of the stages requires different specific cooling capacity. In order to reduce heat exchanger losses, the temperature differences between warm flows and cold flows in the whole LNG production process have to be minimized. By utilizing a multiple of expanders, where each of them can be controlled separately with mass flow, pressure levels and temperatures, it is possible to achieve a close temperature adaptation between refrigeration capacity and the cooling need. Cooling capacities for the three stages are in FIG. 1 represented by three straight lines. Independently controlled expanders give the main contribution to the cooling capacity at each stage. The optimum number of expanders will depend on the gas source composition, gas pressure, required temperatures and the capacity of the LNG plant.

Figure 3:
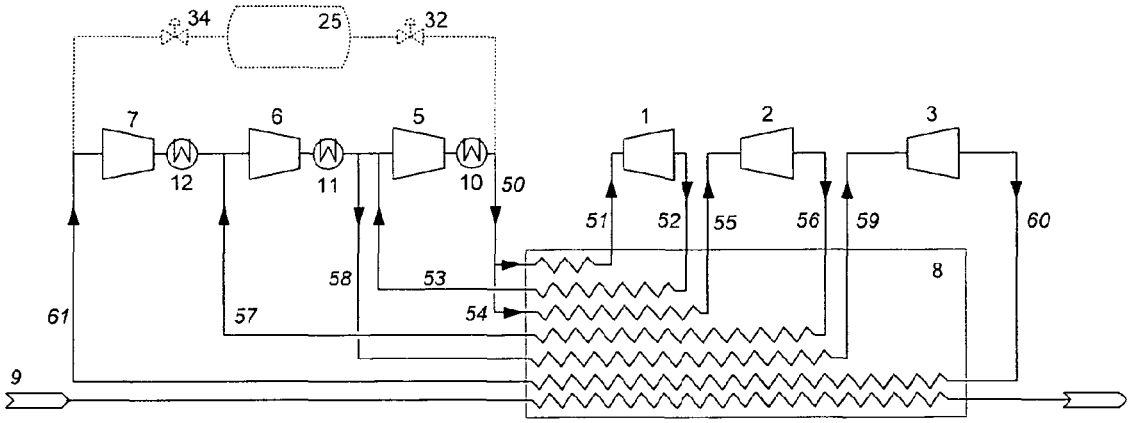
FIG. 3 depicts an embodiment of the present invention including three expanders.

FIG. 3 shows a configuration according to the present invention. Three expanders 1, 2, 3, e.g. turbo expanders, supply a cold box 8 with expanded gas flows at different temperatures adapted to the liquefaction process of the natural gas flow 9. A compressor train 5, 6, 7 serves all three expanders. The expander 3 supplies the cold box 8 with a flow 60 adapted to perform an efficient sub-cooling of the natural gas flow 9, for instance with a temperature interval from −85° C. down to −160° C., see FIG. 1. Above −85° C., the flow 60 contribute with limited net refrigeration capacity in the cold box 8, since a mass flow 59 and mass flow 61 supplied and returned by the expander 3, respectively, are equal. The expander 2 supplies the cold box 8 with a flow 56 adapted to perform the condensation or cooling of gas at high heating capacity, see FIG. 1. This process may have a temperature interval between −85° C. and −25° C. Analogous to the expander 3, the mass flow 55 and mass flow 57 supplied and returned by expander 2, respectively, will have limited contribution to the cooling capacity above −25° C. The expander 1 serves the cold box 8 with a flow 52 adapted to perform the de-superheating from an inlet temperature of the natural gas flow 9, down to the upper working temperature of the expander 2, i.e. −25° C. Supplied and returned mass flows are represented by reference numerals 51, 53.

The compressors 5, 6, 7 are mounted in series forming a compressor train. The compressor train may consist of various number of stages and one or more compressors in parallel at each stage. The pressure ratios over each stage are optimized to the temperature requirements in the cold box 8. These pressure ratios and mass flows may be varied and controlled during operation by speed control of the compressors. Capacities and temperature ranges can then be adjusted.

By varying the total inventory in the arrangement, the overall pressure levels can be varied and overall capacity controlled. An inventory buffer assembly is connected to the suction side of the low pressure compressor stage, and to the discharge side of the high pressure compressor. The valves 32 and 34 are used for control of refrigerant transmission to the buffer tank 25.

Heat is rejected to the ambient by heat exchangers 10, 11,12.

FIG. 3 also shows an example on how the different expanders 1, 2, 3 are connected to the compressor train 5, 6, 7. The expander 3 is fed by outlet gas, flow 58, from a heat rejection heat exchanger 11, whereas the other two expanders 1, 2 are fed by outlet gas, flow 50, 54, from the heat rejection heat exchanger 10. Generally, expander inlet and outlet pressures can be adapted to each expander by applying the present invention.

Figure 7:
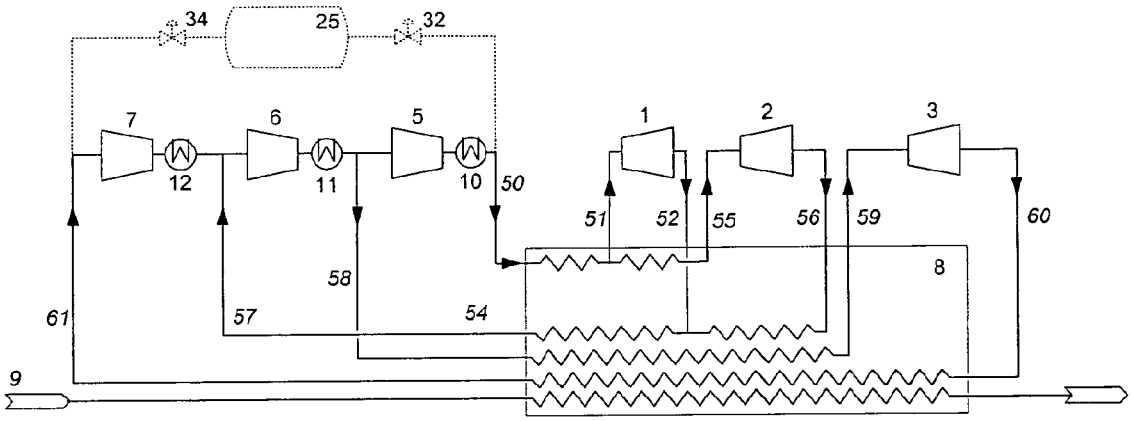
FIG. 7 shows an embodiment allowing for splitting and merging refrigerant streams.

The embodiment according to FIG. 3 illustrates that the cold box 8 is served by three separate expander loops. Due to for instance mechanical requirements for the cold box assembly 8, it may be advantageous to split and merge refrigerant flows in connection with the cold box assembly 8. FIG. 7 shows an example for the splitting and merging of refrigerant flows. The warm flow 50 is split into flow 51 and flow 55 upstream of the expanders. The cold flows 52 and 56 are merged downstream of the expanders into flow 54. By splitting the warm flows upstream of the expanders, and merging the cold flows downstream of the expanders, an efficient process can be achieved. However, this configuration has the inherently disadvantage that individual inlet and outlet pressure adaptation for each expander is not possible. The potential for optimized energy efficiency is reduced.

By applying this embodiment, all of the compressors and expanders are integrated in the same refrigeration arrangement. This gives the potential to make a very compact solution for the rotating equipment, thus reducing cost. Furthermore, each of the compressor stages 5, 6, 7 suck from three different suction pressures, which are formed by the expanders 1, 2, 3. By suction from highest possible pressures, i.e. mass flows 61, 57, 53, the compressor work is minimized, improving the overall efficiency.

The suction volumes of the compressors are also minimized. Pipeline dimensions are reduced with smaller valves and actuators as a consequence. Space need will be considerably reduced and the cost will be lower. The installation work will also become less complicated and more efficient.

A major improvement for the energy efficiency is the use of three separate expander circuits adapted to the three different stages of the natural gas liquefaction. This is unlike prior art technology, e.g. in the U.S. Pat. No. 6,412,302, not having separate adaptation for de-superheating and condensation/cooling of dense phase. The thermodynamic result of the described system can be seen in FIG. 3. By adapting the mass flows, pressure ratios and temperatures of each expander 1, 2 and 3, the heat exchanger losses indicated by the distance between the cold and warm composite curves, can be reduced to a minimum.

The present refrigeration arrangement will operate with the refrigerant in the gas phase. Nitrogen is an obvious gas to apply, since it has favourable properties and is a proven refrigerant. The mole weight is higher than for methane. High molecular weight is advantageous when used in turbo compressor machinery. Methane or hydrocarbon mixtures are proposed used in the U.S. Pat. No. 6,412,302. Hydrocarbons are also flammable, which is regarded as a disadvantage in some applications, for instance in offshore installations.

Figure 4:
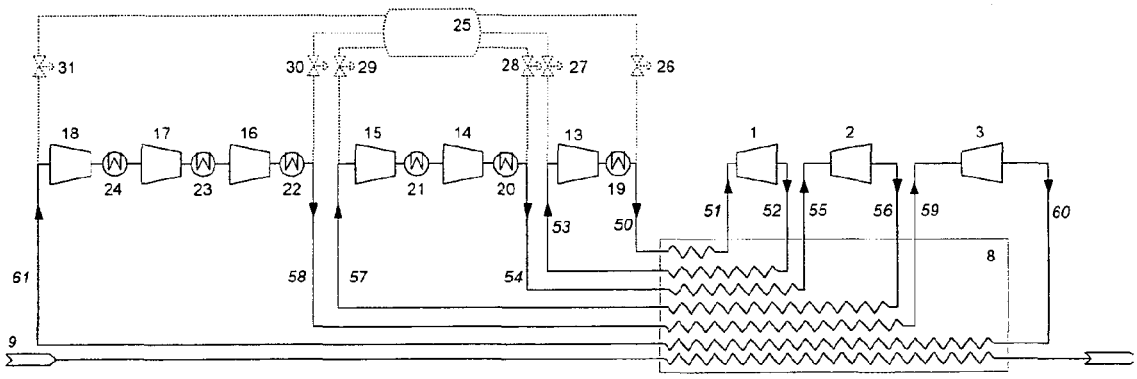
FIG. 4 shows another embodiment including three expanders arranged in three separate refrigeration cycles.

FIG. 4 shows a second embodiment in which each of the expanders 1, 2, 3 is operated in separate cycles with its own compressor configuration. The expander 1, 2, 3 are supplied from the compressor 13, compressors 14, 15, and compressors 16, 17, 18, respectively. The number of compressors or compressor stages may vary in each cycle. As being illustrated in FIG. 3, each of the expanders 1, 2 3 will supply the cold box 8 with refrigeration capacity adapted to the different temperature zones.

Separate cycles give improved flexibility with regard to pressure, temperature and mass flow control, i.e. the refrigeration capacity at the different natural gas liquefaction process stages. Each cycle can be controlled separately with inventory control and compressor speed control. An example of an inventory control assembly is shown in FIG. 4. The three separate cycles are connected to an inventory buffer vessel 25, which is kept at a pressure lower than the lowest high pressure in the cycles, and higher than the highest low pressure in the cycles. The valves 26 to 31 will be used to transfer mass between the cycles and the vessel 25. Even though the cycles work separately, they are connected and dependent of each other when controlling the arrangement. Separate inventory control gives the possibility to vary the overall pressure levels in each cycle.

The flexible control philosophy makes the system with separate cycles robust and adaptable to variations in gas source flows and compositions, and start up situations. A possible disadvantage may be the need of more compressors, However, the total suction volume will principally not increase compared to the system shown in FIG. 3.

Using three expanders in the process of LNG production is basically advantageous as illustrated in FIG. 1. However, even higher efficiencies can be achieved with the use of four expanders or more, not shown. The reason is an even better adaptation between the warm and cold composite curve. Increased complexity can probably be accepted in large scale plants where energy efficiency is decisive.

Figure 5:
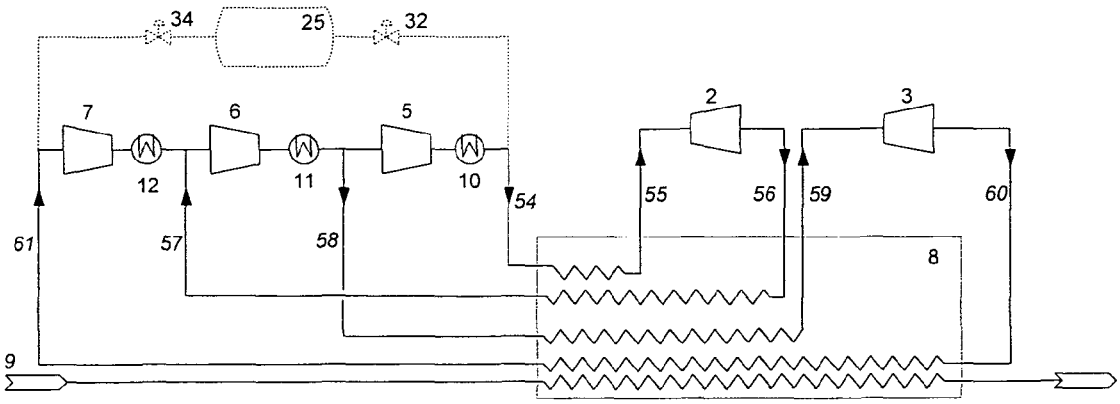
FIG. 5 illustrates an embodiment only including two expanders.
Figure 6:
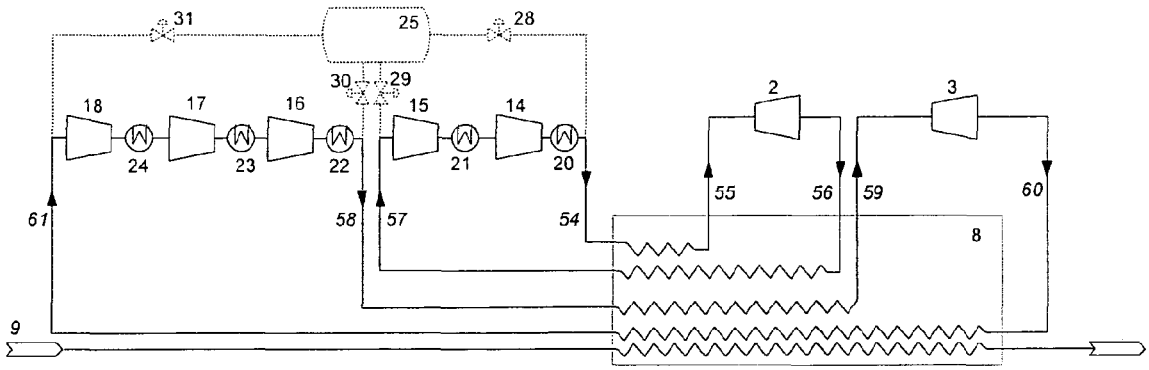
FIG. 6 depicts an embodiment like FIG. 5 but with expanders arranged in separate refrigeration cycles.

FIGS. 5 and 6 show embodiments for LNG production based on the same principles as illustrated by FIGS. 3 and 4, but with two expanders instead of three. FIG. 5 depicts an example having a common compressor train, and FIG. 6 shows an example comprising separate cycles. In both of the cases illustrated, the expander 3 is adapted to sub-cooling the liquefied natural gas, whereas the expander 2 is adapted to de-superheating and condensation/cooling of dense gas. The expander 2 is hence used for production of liquefied natural gas, whereas the expander 3 is used for sub-cooling. The adaptation between the warm and cold composite curves will be poorer compared to the solutions having three expanders, but the configuration is less complex. The total compressor suction volume will not decrease compared to the embodiment having three expander, since the suction capacity of the compressors 6, 5 or 14, 15 must be increased to handle both de-superheating and condensation/dense gas cooling.

As for the described systems with three expanders, the capacity control can be performed by inventory control and compressor speed control. For the separate cycles, see FIG. 6, pressure levels can be controlled independently for the two cycles. Inventory control is carried out by a refrigerant mass buffer system including a vessel 25 and the valves 28, 29, 30 and 31. Pressure in the vessel 25 is kept lower than the lowest high pressure and higher than the highest low pressure in the system. The valves are used for mass transfer to and from the vessel. For the connected system in FIG. 5, the inventory control is arranged by a vessel 25 and the valves 32 and 34. By varying the process inventory, the overall pressure levels can be changed and capacity controlled. Compressor speed variation can be used to vary the overall capacity, but also for separate control of each compressor stage giving the opportunity to vary capacity on different pressure levels.

Figure 8:
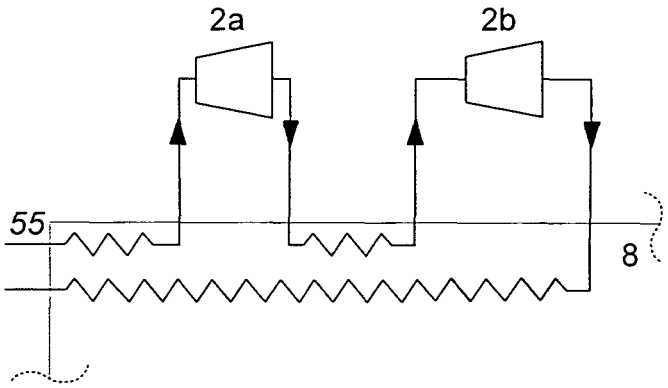
FIG. 8 illustrates a section of FIG. 7 in which at least one of the expanders illustrated in FIGS. 3 to 6 is provided with expanders coupled in series.

The expander 2 in FIGS. 5 and 6 provides the cooling capacity in the high temperature cycle. This cooling capacity can for instance be provided by two expanders in series, see FIG. 8. The mass flow 55 will first be expanded in expander 2*a* down to an intermediate pressure and sub-cooled in the cold box 8, before a final expansion through a second expander 2*b* down to the low pressure of the high temperature cycle. Complexity will be slightly increased, but it will improve the energy efficiency. In principle, any of the expanders 1, 2 and 3, can be replaced by two or more expanders in series.

All the above proposed solutions are not limited to liquefied natural gas production. Reliquefaction of boil off gas, which also is regarded as a natural gas, is another application wherein the present invention can be used, for instance on marine LNG carriers and in onshore terminals.

Although not illustrated in the drawings, it is understood that more than three expanders are applicable, e.g. four or even more.

EXAMPLE

Applying the present invention, e.g. as shown in FIG. 3 to a typical natural gas source, calculated energy efficiencies of around 0.32 kWh/kg LNG can be achieved, depending on the external conditions. Comparing to prior art solutions, e.g. according to U.S. Pat. No. 6,412,302 which has a calculated energy efficiency of 0.44 kWh/kg LNG at equal ambient condition and based on operational data suggested in this description, it is a significant improvement.

The invention claimed is:

1. A method for producing liquefied and sub-cooled natural gas using a refrigeration assembly comprising a single phase gaseous refrigerant and comprising at least two refrigeration cycles each comprising an expander arranged in an expander loop, wherein a single-component refrigerant is used as the refrigerant in all expander loops, a compressor assembly, a heat exchanger structure for heat absorption from natural gas, a heat rejection assembly and an inventory vessel, the method comprising:

passing an expanded refrigerant flow from each respective expander into the heat exchanger structure, each expander being at a mass flow and temperature level adapted to perform de-superheating, condensation or cooling of dense phase and/or sub-cooling of natural gas; and serving the refrigerant to each respective expander in a compressed flow using the compressor assembly having compressors or compressor stages enabling adapted inlet and outlet pressures for each respective expander, wherein each of the refrigeration cycles is connected to the inventory vessel, and refrigeration capacities of the refrigeration cycles are controlled independently from each other by varying refrigerant inventories of the refrigeration cycles using the inventory vessel and valves.

2. The method of claim 1, wherein the refrigerant comprises nitrogen.

3. The method of claim 1, wherein the expanders are connected to the compressor assembly as to fluidly form an integrated refrigeration assembly with separate expander loops.

4. The method of claim 1, wherein each expander is connected to the compressor assembly as to fluidly form separate refrigeration cycles.

5. The method of claim 1, wherein refrigeration capacities are independently varied in each of at least two cycles by separate inventory control.

6. The method of claim 5, wherein the refrigeration capacities are controlled by compressor speed control.

7. The method of claim 1, wherein two or more expanders are connected in series with intermediate cooling between expander stages.

8. A system for producing liquefied and sub-cooled natural gas comprising a refrigeration assembly using a single phase gaseous refrigerant, the refrigeration assembly comprising:

at least two refrigeration cycles each comprising an expander;

a compressor assembly;

a heat exchanger structure for heat absorption from natural gas;

a heat rejection assembly; and an inventory vessel, wherein the expanders are arranged in expander loops, a single-component refrigerant is used as the refrigerant in all loops, an expanded refrigerant flow from each respective expander is passed into the heat exchanger structure, each respective expander being at a mass flow and temperature level adapted to perform de-superheating, condensation or cooling of dense phase and/or sub-cooling of natural gas;

the refrigerant to each respective expander is served in a compressed flow using the compressor assembly having compressors or compressor stages enabling adapted inlet and outlet pressures for each respective expander;

each of the refrigeration cycles is connected to the inventory vessel, and refrigeration capacities of the refrigeration cycles are controlled independently from each other by varying refrigerant inventories of the refrigeration cycles using the inventory vessel and valves.

9. The system according to claim 8, wherein the refrigerant comprises nitrogen.

10. The system of claim 8, wherein the expanders are connected to the compressor assembly as to fluidly form an integrated refrigeration assembly with separate expander loops.

11. The system of claim 8, wherein each expander is connected to the compressor assembly as to fluidly form separate refrigeration cycles.

12. The system of claim 8, wherein refrigeration capacities are independently varied in each cycle by separate inventory control.

13. The system of claim 12, wherein the refrigeration capacities are controlled by compressor speed control.

14. The system of claim 8, comprising two or more expanders connected in series with intermediate cooling between expander stages.

* * * * *